United States Patent [19]

Green et al.

[11] 4,241,796

[45] Dec. 30, 1980

[54] ACTIVE DRILL STABILIZER ASSEMBLY

[75] Inventors: Sidney J. Green, Salt Lake City; Floyd H. Shipman, Holladay; Carl J. H. B. Van Kempen, Salt Lake City, all of Utah

[73] Assignee: Terra Tek, Inc., Salt Lake City, Utah

[21] Appl. No.: 94,586

[22] Filed: Nov. 15, 1979

[51] Int. Cl.[3] ..... E21B 44/00

[52] U.S. Cl. ..... 175/24; 175/45; 175/76; 33/178 F

[58] Field of Search ..... 33/178 F, DIG. 2; 175/24, 38, 45, 73, 76, 231; 73/37.9

[56] References Cited

U.S. PATENT DOCUMENTS

| | | | |
|---|---|---|---|
| 2,358,769 | 9/1944 | Aller | 73/37.9 |
| 3,313,360 | 4/1967 | Frisby | 175/45 |
| 3,823,787 | 7/1974 | Hawarth et al. | 175/24 |
| 3,853,186 | 12/1974 | Dahl | 175/24 |
| 3,997,008 | 12/1976 | Kellner | 175/45 |
| 4,016,747 | 4/1977 | Rader | 73/37.9 |
| 4,164,871 | 8/1979 | Cole et al. | 175/24 |

*Primary Examiner*—William F. Pate, III

*Attorney, Agent, or Firm*—M. Reid Russell

[57] ABSTRACT

The present disclosure concerns an active drill stabilizer assembly for arrangement in a drill string directly behind a conventional or modified drill bit that utilizes drilling fluid as a sensing and working deviation/correction energy source. In a sensing loop of the present invention, the drilling fluid passes through groups of pitch and yaw sensor outlet ports and orifices that direct the fluid against the bore-hold side wall. The flow through the orifices is proportional to the gaps between the outlet ports and the well bore side wall and grouping of the sensors provides for an "averaging effect" to the fluid flow that ignores local side wall surface irregularities and produces an instantaneous venturi throat pressure for each axis.

31 Claims, 14 Drawing Figures

ACTIVE DRILL STABILIZER ASSEMBLY

DESCRIPTION OF THE INVENTION

1. Field of the Invention

This invention relates to mechanical devices for arrangement with conventional or modified drill bits for sensing direction deviations from, and making corrections back to desired drilling paths, in both horizontal and vertical drilling operations.

2. Prior Art

A problem common to both horizontal and vertical drilling operations has traditionally been to drill a straight hole and/or a guided hole. Particularly, this problem is compounded as the length or depth of the drill hole increases. Obviously, if the rock being drilled through is ideal, such difficulties in making a straight bore hole are reduced. However, this is generally not the case and, as for example, it has been found to be difficult to achieve deviations of much less than five degrees in horizontal drilling. Such deviation angles of five degrees are currently considered quite good but, as an example, such deviation in a two-thousand foot hole would represent an error of plus or minus one hundred and seventy-five feet. In operations such as an insitu recovery process, where the hole pattern is critical, or drilling in a coal seam, or the drilling of a tunnel pilot hole such an error would be unacceptable. While in vertical drilling operations the force of gravity on a drill bit and drill string acts favorably in producing a vertical hole, the differences in rock makeup and consistency can produce significant deviations, particularly in deep well drilling.

Heretofore, a number of devices have been developed to provide a "smart" drill bit that includes instrumentation behind a drill bit that senses direction changes and provides for a correction of the drilling angle to compensate for that deviation to a nearly straight bore. An example of such device is shown in a patent by Kostylev, et al., U.S. Pat. No. 3,677,354, that provides for both deviation sensing and changing of drilling direction to correct for such deviation. Common to the above Kosylev patent and U.S. Pat. Nos. by Jeter, et al., 3,424,256, Bourne, Jr., 3,888,319, and Gaskell, et al., 3,141,512, are instrumentation for sensing deviations from a drilling path, and apparatus for correcting that deviation by changing a drilling angle. Such devices are defined as "smart" in that they compensate for deviations from a desired path without surface control or direction. The present invention provides such a "smart" device in that it is capable of operations where it senses and corrects for drilling deviations without surface control, but is unlike any of these devices, or any device within the knowledge of the inventors, in that its sensing arrangement is much less complex than earlier devices and it utilizes the drilling fluid for both sensing deviations and as a working media or energy source for operating actuators or rotary valves and push-off pad combinations for correcting a drilling direction from such deviations back to a desired drilling path.

Prior deviation sensing devices, unlike the present invention, have generally involved, as sensors, a mechanical member or members that extend from the device for contacting the well bore wall, with the distance of that extension interpreted as being the amount of deviation. Assuming that drill holes are uniform, such would possibly be appropriate and functional. However, in actual practice, such uniformity is generally not the case. Further, mechanical members in the hostile environment encountered in drilling operations have obvious problems of reliability. The present invention unlike former devices does not involve mechanical sensing, but instead utilizes a fluid sensing loop wherein pressure head changes induced by a fluid flow groups of spaced ports are averaged and directional control thrust members, that are also fluid operated, provide drilling direction change. This arrangement is more accurate and reliable than former devices.

The present invention provides additional versatility and is unlike former devices in that heretofore it has not been possible to artificially create a pressure head change that is acted upon as a deviation. The present device then appropriately corrects that artificially created pressure head change, changing the drilling direction appropriately. The present invention can thereby be operated remotely to steer a drill bit, as desired. Such arrangement can be linked to and controlled from the surface, as by a computer, and/or can continuously provide deviation/correction information sufficient to allow monitoring and recording of drill bit location, taking into account the length of the drill string at a particular time.

Within the knowledge of the present inventors, there has not heretofore existed an apparatus like that of the present invention, which apparatus is therefore believed to be both novel and unique and a significant improvement in the art.

SUMMARY OF THE INVENTION

It is a principal object of the present invention of an active drill stabilizer assembly to provide an arrangement for inclusion with a fluid carrying drill shaft and conventional or modified drill bit for sensing deviations from a desired drill path and for correcting the drilling direction to compensate for those deviations, so as to drill along the desired path, independent of control.

Another object of the present invention is to provide, as a component of the active drill stabilizer assembly, a fluid operated sensor loop or unit wherethrough drilling fluid is passed that is directed by pitch and yaw nozzles against the bore hole side walls, to create and amplify for control purposes, pressure head losses through the nozzles. Another object of the present invention is to provide embodiments of fluid operated thrust assemblies operated responsive to the pressure head losses to create a bending torque sufficient to alter drilling direction.

Still another object of the present invention is to provide, a capability for programming or introducing a false deviation signal that will be acted upon and corrected for to provide a steering capability thereto.

Still another object of the present invention is to provide a device that is linked to surface instrumentation, receiving signals therefrom that are acted upon as deviation signals, and transmitting deviation/correction information thereto for recording, plotting and analysis, providing thereby a steering and feedback capability.

Principal features of the present invention in an active drill stabilizer assembly include a housing wherethrough a drill shaft is journaled that connects to a drill string. The drill shaft preferably mounts on its forward end, a reaming collar and a conventional or modified drill bit. The present invention is preferably arranged behind the reaming collar and, preferably, in one embodiment, is made up of four sub-assemblies that include: a sensor loop or unit; a hydraulic control unit; a directional thrust unit; and a hydraulic metering unit and in another embodiment includes: the same sensor loop or unit; a hydraulic control valve unit; and a directional thrust unit.

Both embodiments of the present invention include appropriate bearing arrangements that allow the drill shaft, reaming collar and drill bit to rotate while the housing is stationary. A spherical bearing is associated with the reaming collar and gets to minimize friction when side forces are applied to the drill shaft and bit due to deviations from or corrections back to a desired drilling path. Corrections to the drilling direction, of course, require that a force be applied direction (a) against the drill shaft to change its drilling angle; or (b) to push the drill stabilizer assembly away from a well bore side wall so operated. The bore reaming collar acts as a fulcrum. Such force application is provided, in one embodiment, by a directional thrust unit that includes fluid actuators that utilize the drilling fluid as an energy source and operate on command from the hydraulic control unit. This operation utilizes an extension of rod portions thereof that operate through a linkage to, alternatively, provide a bending force against the drill shaft directly or act against the hole side wall to alter the drilling direction.

Both embodiments of the active drill stabilizer assembly of the present invention also incorporate the described sensor loop or unit. This unit senses and averages head losses developed by fluid flow out of orifices of the sensor section. The head losses are dependent upon the distance of the orifice from the well bore wall. The head losses are averaged through the use of grouped orifices and are compared with the averaged head losses in the diametrically opposite sensor loops to, in conjunction, open appropriately a differential pressure valve in one embodiment and a rotary valve in the other. The differential pressure valves or rotary valves port fluid flow, respectively, to operate thrust actuators in one embodiment or beneath a push-off pad or pads to extend that pad or pads against the well bore wall in the other embodiment.

The directional thrust unit actuators are operated by a fluid flow from and controlled by differential pressure amplifier control valves, that are arranged in pairs, one pair for each pitch and yaw axis and which function to extend and retract hydraulic cylinder rods to apply through a linkage a torquing force against the drill shaft or well-bore wall to effect a drilling direction change. Each differential pressure amplifier control valve preferably includes pilot valves, that each have a hydraulic amplifier connected thereto and, in turn, control actuator operations as outlined hereinabove. Further, this embodiment also includes a hydraulic metering unit that maintains proper fluid flow rates to both the sensing loop and for actuator operation.

The sensor loop or unit of the present invention preferably consists of tandem arrangements of groups of sensor outlet ports and orifices for each axis. The groups extend longitudinally along the housing, parallel to one another. Each set of two parallel groups are diametrically across from one another and represent respectively, the pitch or yaw axis. In operation, drilling fluid, as the sensing medium, passes through the sensor unit outlet ports and orifices and strikes the well bore wall. The flow rate through the outlets is sufficient to overcome and pass through the fluid layer returning from the bore hole face housing. Pressure head losses produced by the flow through sensor unit in the embodiment that utilizes actuators are amplified at differential pressure amplifier control valves that operate as described above to control actuator operation. In the second embodiment the head losses directly operate rotary valves that port high pressure fluid direction beneath a push-off pad or pads which extend to contact the well bore wall. Pilot control valves are arranged with the first embodiment that are connected to and controlled by the pitch or yaw differential pressure amplifier control valves to operate the appropriate direction thrust actuators, as described.

While sensor units consisting of single or pairs of outlet ports and orifices arranged at ninety degree intervals around the housing are preferably used to sense deviations in both pitch and yaw axis, three or more than four such tandem outlet ports and orifices could be so used to provide an averaged pressure head loss, as described.

Obviously, to inhibit the generation of constant or nearly constant correction signals, it is desirable to preset or build in certain threshhold pressure head losses or differential pressures that must be reached for actuator or rotary valve operation. Such programming is provided for by appropriate settings in the hydraulic metering unit in the first embodiment and by a spring arrangement in the rotary valve in the other. It is preferred to include, with both embodiments, an arrangement for holding a correction a sufficient length of time to move the drill bit to a desired attitude and desensitize the sensor loop from normal high frequency displacements of the drilling apparatus that result from rock drilling operations.

As the sensor loop or unit of the present invention operates on venturi thrust pressure changes or head losses, it lends itself to receiving or having pre-programmed artificial deviation indications. Such artificial deviation indications can be generated from within the unit or from a surface controller connected to the device by radio, wires, or the like to operate, respectively, the differential pressure amplifier control valve in one embodiment, or the rotary valve in the other. The apparatus of the present invention can, therefore, be arranged to drill along a pre-selected curve or path within, of course, the limitations of drilling mechanics. It can also be arranged by connection to the surface to be "steered" by passing appropriate signals from a controller. Further, when connected to the surface, deviation and correction information can be transmitted as electrical signals back to the surface to provide for a continuous plotting of the location of the drill bit taking into account drill string length. Such deviation/correction data can also be useful for providing data for analyzing the rock makeup wherethrough drilling operations progress.

Further objects and features of the present invention will become more apparent from the following detailed description, taken together with the accompanying drawings.

THE DRAWINGS

FIG. 1, is a side elevation view of a first embodiment of the present invention in an active drill stabilizer assembly shown arranged with a drill shaft and drill bit with reaming collar connected thereto;

FIG. 2, a sectional view taken along the line 2—2 of FIG. 1, showing in schematic, the unit assemblies of the embodiment of FIG. 1 as they are arranged around the drill shaft that is shown extending therethrough;

FIG. 3, an enlarged side elevation view of a preferred sensor unit of the present invention shown arranged in a drill hole;

FIG. 4, a sectional view taken within the lines 4—4 of FIG. 3, showing an expanded view of a sensor unit outlet port and orifice;

FIG. 5, a flow schematic of hydraulic control, directional thrust and hydraulic metering units of the first embodiment of FIG. 1, for illustrating the flow therethrough;

FIG. 6, an enlarged side elevation view of a yaw or pitch axis directional thrust unit of FIG. 2;

FIG. 7, an end sectional view taken along the lines 7—7 of FIG. 6, showing the directional thrust unit as including a clevis connection to a yoke, which yoke is shown pivotally coupled to actuators and is arranged to turn a jacking screw arrangement shown in sold and broken lines;

FIG. 8, shows, in reducing sections, a surface connection of the present invention to a controller for monitoring and commanding operation thereof;

FIG. 9, a broken expanded sectional view of the differential pressure amplifier control valve component of the sensor unit of FIG. 3, showing electro-magnetic wire coils wrapped therearound operating as a solenoid, one coil arranged for monitoring valve piston positioning for transmittal to the surface controller of FIG. 8, and the other coil arranged to receive electronic commands from the controller that move appropriately the valve piston;

FIG. 10, a profile view of another embodiment of a hydro-mechanical drill stabilizer of the present invention showing a longitudinal section removed therefrom exposing the component elements of the device;

FIG. 10(*a*), a cross-sectional view taken along the line 10(*a*)—10(*a*) of FIG. 10, showing a rotary valve element thereof;

FIG. 10(*b*), a cross-sectional view taken along the line 10(*b*)—10(*b*) of FIG. 10, showing push-off pad elements thereof;

FIG. 10(*c*), a sectional view taken along the line 10(*c*)—10(*c*) of FIG. 10, showing fluid flow feed lines connected to the rotary valves of FIG. 10(*a*) for providing drilling fluid flow thereto; and FIG. 11, an expanded sectional view taken within the line 11—11 of FIG. 10, showing a side elevation view of a portion of a stacked rotary valve arrangement of the present invention.

DETAILED DESCRIPTION

Background

Figure 1:
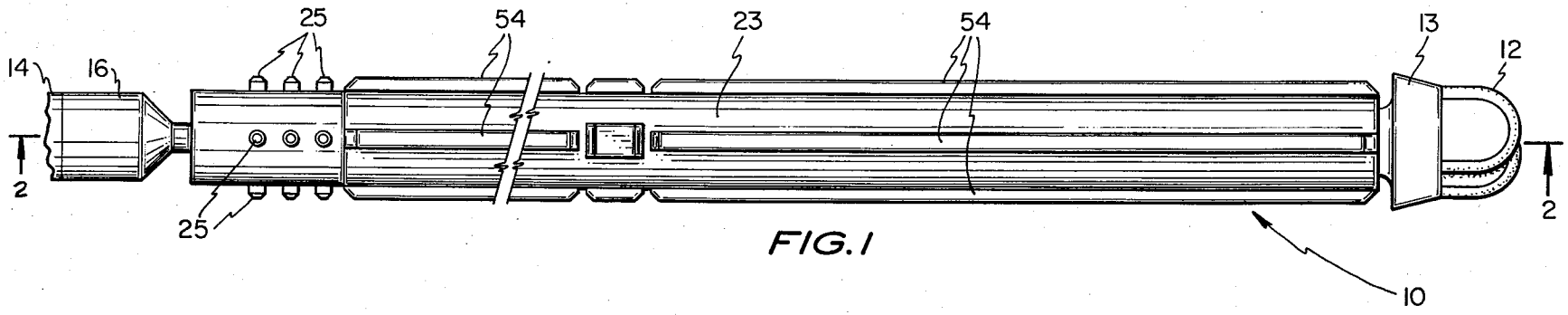

Referring now to the drawings:

The present invention in an active hydro-mechanical drill stabilizer assembly hereinafter referred to as drill stabilizer assembly, is a device that is appropriate for use in either horizontal or vertical drilling operations as a self-correcting or "smart" drill bit. By the term "smart" drill bit is meant a device capable of both sensing a deviation from a desired or programmed drilling path and self-correcting the drilling direction to return the drill bit back to that desired path. The present invention, additional to providing such a "smart" drill bit, when it is appropriately connected to a surface installation, can be steered therefrom by a surface guidance system, and can provide deviation/correction information back thereto through such connection for use in plotting drill bit location and for providing information about the rock being drilled through. Unique to the present invention is the use of conventional drilling fluid as both the sensing medium and energy source for effecting drilling direction changes. Drilling fluid is, of course, the fluid normally supplied from the surface or drilling station through the drill shaft for lubricating and cooling the drill bit during drilling operations.

Prior devices that could be classified as "smart" by the above definition have assumed a very high quality and uniform drill hole and such, in practice, is often not the case. Therefore, a device that utilizes an extending arm, piston or the like, as do earlier devices for contacting the drill or bore hole wall, to sense for deviations runs the risk that, should such wall contact be made into a cavity or hole therein, then a resulting command for correction will obviously result in an error. The present invention allows for such a lack of smooth drill hole wall by utilizing a sensor unit that incorporates groups of single or pluralities of outlet ports and orifices to pass drilling fluid therethrough and direct it against the bore wall. An average pressure head loss between the outlet ports and orifices in each group is thereby obtained that is sensed as a deviation in that axis. The effect of averaging of pressure changes, of course, makes allowance for a lack of smoothness of the well bore wall.

The Active Hydro-Mechanical Drill Stabilizer Assembly

Figure 2:
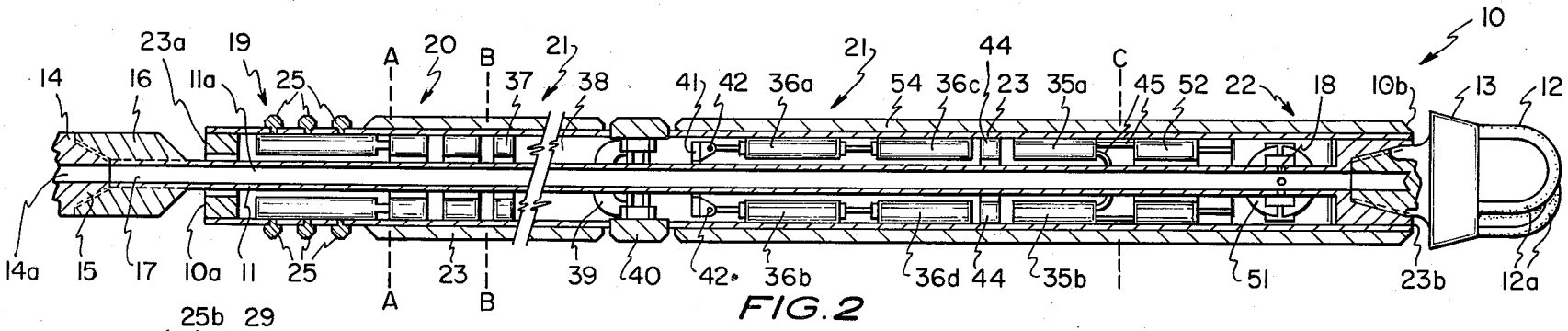

In FIGS. 1 and 2 is shown a first preferred embodiment of the present invention in the drill stabilizer assembly 10 that is shown as having a drill shaft 11 fitted therethrough that is coupled to drill string 14. The drill shaft 11 has a longitudinal passage 11*a* formed therethrough and couples at a forward end thereof to a reaming collar 13 that has a drill bit 12 attached thereto. Shown in the cross-sectional view of FIG. 2, the drill string 14 has a longitudinal tube 14*a* formed therethrough that couples to drill shaft 11 at collar 16 for passing fluid. Collar 16 is threaded internally, as shown at 17, to connect to the drill string 14, as shown in FIG. 2, aligning the longitudinal tube 14*a* to the drill shaft longitudinal passage 11*a*. A drilling fluid flow travels therethrough, exiting through openings 12*a* in drill bit 12 for use in drilling processes. Additionally, a portion of that fluid is tapped from the drill shaft 11 through fluid ports 18 that extend therefrom and through a spherical bearing 51 for distribution by hydro-mechanical portions of the drill stabilizer assembly 10, as the sensor unit medium and as the energy source, as will be explained in detail later herein.

Shown in FIGS. 1 and 2 the drill stabilizer assembly 10 is preferably contained within a cylindrical body 23, and, as shown best in FIG. 2, consists of four subassemblies that are broadly defined as: a sensor unit 19; a hydraulic control unit 20; directional thrust unit 21; and a hydraulic metering unit 22. Shown in FIG. 2 and FIG. 5, sensor unit 19 is arranged between a rear end 23*a* of the body 23 to approximately a broken line "A". The hydraulic control unit 20 occupies the area from broken line "A" to approximately a broken line "B" and contains pitch and yaw venturies and differential pressure amplifier control valves, which valves are hereinafter referred to as differential pressure valves 31, one of which valve is shown best in FIG. 3. Continuing from left to right in FIG. 2, the directional thrust unit 21 is arranged between broken line "B" and a broken line "C", and contains pitch and yaw actuators, steering pads, and steering controls for both pitch and yaw axis. Continuing from left to right the hydraulic metering unit 22 is shown that includes a fluid control metering manifold 52, the spherical bearing 51 and fluid ports 18 and is arranged between broken line "C" to a forward end 23*b* of body 23, and is also shown within a broken line box labeled "D" in FIG. 5.

The units listed hereinabove, as shown in FIG. 2 are fitted within body 23, placed appropriately around the drill shaft 11. Therefore, the flat sectional views of FIGS. 2, 3 and 6 can show only cross sections of the assemblies, and so it should be understood, the component assemblies are alike for both pitch and yaw axis and are appropriately connected together by lines to provide required flows therebetween. For example, in this embodiment, components or assemblies involved with pitch axis are arranged across from one another and yaw axis components or assemblies are at right angles thereto across from one another. Further, as the present invention, by the nature of its use below the surface, operates in what could be termed a hostile environment, it should be understood that the various parts and components are preferably of ruggedized construction and many components can be integrally machined into the body 23.

Figure 3:
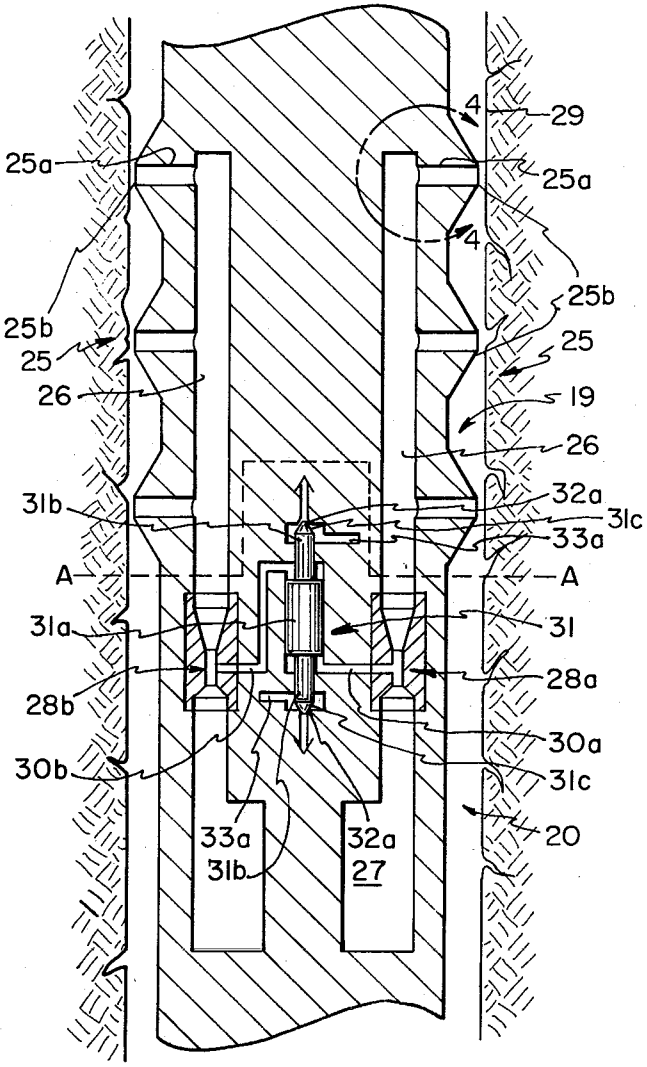

In FIG. 3 is shown a sectional view of that part of body 23 that contains both sensor unit 19 and hydraulic control unit 20, which units, as stated above, for both pitch and yaw axis are the same and so a description of the arrangement of FIG. 3 should be taken as being for the units for both axes. Sensor unit 19, as shown best in FIG. 3, preferably includes tandem groupings of multiple sensors 25 that include outlet ports 25*a* and orifices 25*b*. The sensor outlet ports and orifices extend longitudinally and the units are aligned essentially parallel to one another around the body 23, spaced apart at ninety degree (90°) intervals between yaw and pitch groupings. Shown best in FIG. 3, the outlet ports 25*a* are connected by a common line 26 to receive fluid from a reservoir 27 that is located in the hydraulic control unit 20. While the connecting lines are not shown in FIG. 3, it should be understood that reservoir 27 receives fluid from the fluid control metering manifold 52. In operation, fluid, under pressure, that should be taken as preferably as drilling fluid, passes from reservoir 27 through matched measuring venturis 28*a* and 28*b*, through lines 26, passes through outlet ports 25*a*, and is directed as a stream out of each orifice 25*b*, against the well bore or hold wall 29. The flow rates out of orifices 25*b* of groups of sensors 25 that make up sensor unit 19 should be taken as being sufficient velocity to overcome a fluid back flow over body 23 from drill bit 12 such that each will produce a venturi pressure head loss that is averaged. The averaged head losses are then compared with averaged head loss of other sensor units 19 around body 23, and when the losses are different, this indicates that drilling is off course and tells in which axis or between which axes it is off course.

Figure 4:
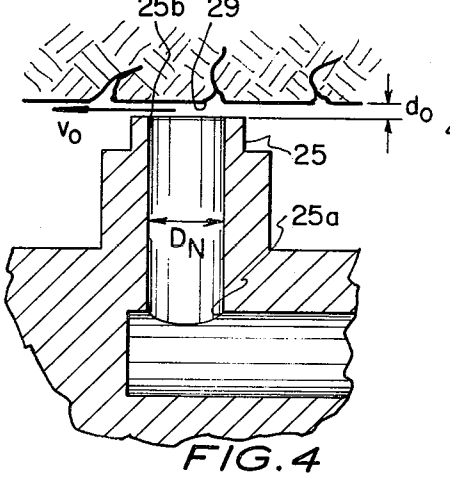

Functionally, the sensor and hydraulic control units 19 and 20 operate as follows: the sensor orifice 25*b* flow rate is proportional to the gap or space between the orifice 25*b* end and bore hole wall 29. The connected sensors 25 produce and average flow rate that is sensed as head loss at a venturi 28*a* or 28*b*, which phenomenon is commonly known as the Bernoulli effect. The required flow rate is illustrated in FIG. 4. Thereon is shown one of the sensors 25 that includes port 25*a* and shows orifice 25*b* thereof located immediately opposite to well bore wall 29. The orifice 25*b* is shown having internal diameter $D_N$, with a gap distance "$d_o$ between the orifice end and well bore wall 20. In practice it has been found that as long as the cross-sectional area of the orifice 25*b* opening ($D_N2$) is substantially larger than the area controlled by $d_o$, that is defined by the circumference of the opening times height, the effective area controlling the flow is the cylindrical shape of the area $D_Nd_o$. With three sensors 25 in use, then the area controlling flow would be $D_Nd_o$, and therefore, flow rate therethrough must be sufficient to overcome a fluid back flow along the housing 23 exterior. Providing such sufficient flow rate through sensors 25, then the resulting flows provide head losses that can be averaged.

Head losses, as shown in FIG. 3, are sensed through lines 30*a* and 30*b* that connect the venturis 28*a* or 28*b* to, respectively opposite ends of differential pressure valve 31. The differential pressure valve 31, shown in FIG. 3 and 9, contains piston 31*a* that is arranged to move in response to a difference in venturi throat pressure or a difference in head losses. So arranged, from piston 31*a* opposite ends rods 31*b* that extend at normal angles thereto, which rods include pointed ends 31*c* that act as valve faces and fit into valve seats 32*a* opening or closing off appropriately a fluid flow therethrough that travels into lines 33*a* and 33*b*, respectively. Fluid flow through seats 32*a*, it should be understood, is generated from fluid control metering manifold 52 and is arranged to be normally vented to ambient conditions when no differential pressure condition exists.

Figure 5:
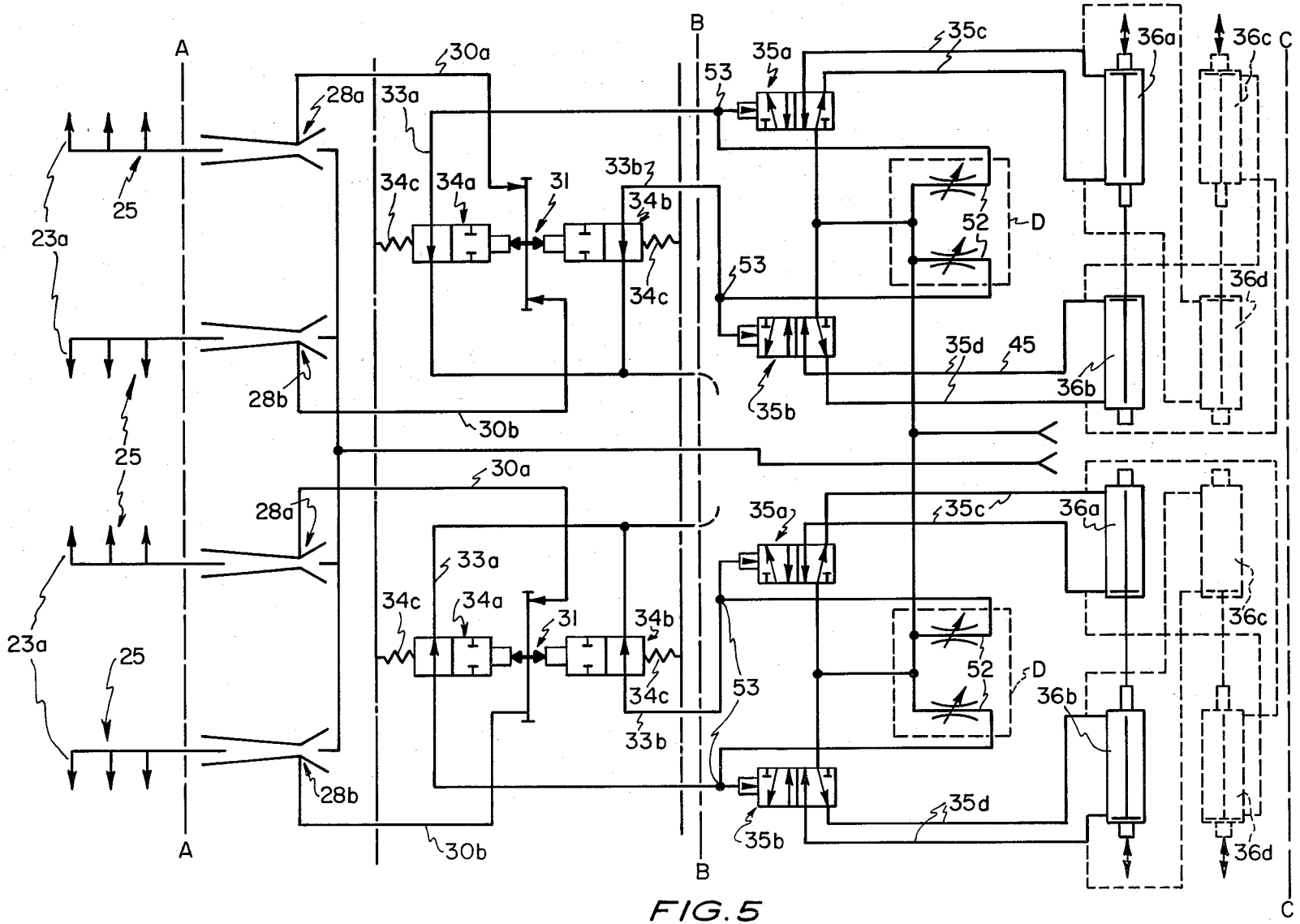

Shown best in the schematic of FIG. 5 that shows a preferred fluid flow for the units of either the pitch or yaw axis, fluid is directed through lines 33*a* and 33*b* to operate pilot control valves 34*a* or 34*b*. Pilot control valves 34*a* and 34*b* are preferably set, as by springs 34*c*, or the like, to have a pressure threshhold which must be overcome to operate. Thereby, only a flow greater or less than a set rate will open appropriately, actuator valves 35*a* or 35*b*. When such threshhold rate is exceeded, actuator valve 35*a* or 35*b* then operate to pass drilling fluid as the preferred energy source to actuators 36*a*, 36*b*, 36*c* and 36*d* that function, as will be described later herein, to change the drilling direction.

Also, as illustrated by the schematic of FIG. 5, flow rate to the actuators 36*a*, 36*b*, 36*c* and 36*d* is dependent upon and controlled by the fluid control metering valves 52 of the hydraulic metering unit 22, that are shown in broken line box "D", as constrictions with arrows therethrough. Assuming such preset threshhold pressure is surpassed, fluid will be passed to one or the other of the ends of actuators 36*a* and 36*b* shown in sold lines, and 36*c* and 36*d* shown in broken lines. Thereby, as will be explained later herein, pistons of the pairs of actuators are appropriately extended or retracted. The broken line configuration shown for actuators 36*c* and 36*d* are intended to illustrate they are optional and that more than one actuator 36*a* and 36*b* can, but need not necessarily, be arranged in combination therewith for appropriate coordinated piston movement to provide an adequate total force to create sufficient bending movement on either the drill shaft 11 or against the well bore wall 29 for effecting a change in drilling direction.

In FIG. 2, a preferred arrangement of pitch and yaw directional thrust units are shown included within the directional thrust unit 21. FIG. 2, as it is cross section, cannot, of course, simultaneously portray both pitch and yaw directional thrust units and, therefore, the details of yaw actuators only will be shown. However, as the pitch and yaw actuators operate identically, an explanation of one such grouping should be taken as an explanation of the other also. Referring to FIG. 2, and progressing from left to right therein, alongside broken line "B" is shown a pitch actuator mounting ring 37, which is, of course, part of the pitch portion of the directional thrust unit 21, the housing 23 thereat shown broken, wherein the pitch actuators would be housed, which actuators connect to a pad 40 shown alongside the break.

Figure 6:
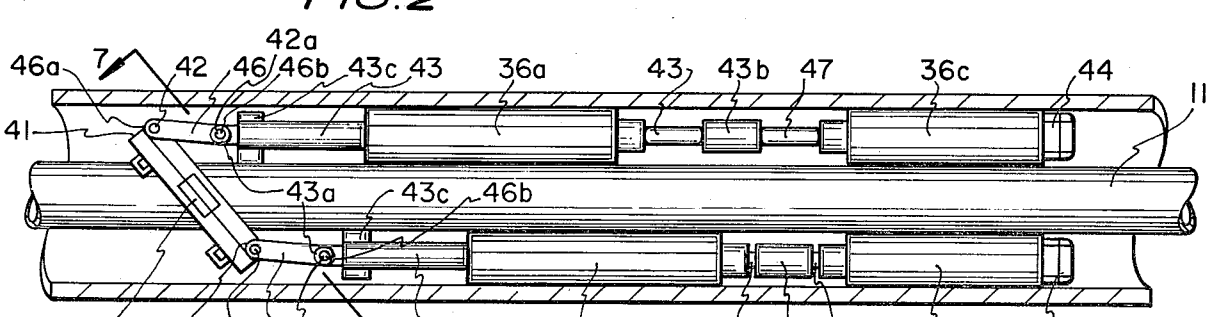

Alongside the pad 40, continuing from left to right in FIG. 2 and 6, is shown a yaw steering yoke 41. The yaw steering yoke connects on opposite sides thereof to actuators 36*a* and 36*b* at piston-portions thereof which actuators 36*a* and 36*b*, in turn, are linked to actuators 36*c* and 36*d*, respectively. Shown best in FIG. 6, yaw steering yoke 41 is pivotally connected along opposite sides thereof by pivots 42 to ends 46*a* of bars 46 that, in turn, are each pivotally coupled at opposite ends 46*b* by pivots 42*a* to ends 43*a* of pistons 43. Pistons 43 are shown to extend, respectively, through actuators 36*a* and 36*b* and each couples at 43*b* to pistons 47 that, in turn, extends, ontowardly from an end of actuators 36*c* and 36*d*. Actuators 36*c* and 36*d*, are, in turn, secured to a yaw actuator mounting ring 44 that maintains them in place within body 23.

As shown best in FIG. 6, actuators 36*a* and 36*b* are free floating with the travel of pistons 43 preferably guided by guide blocks 43*c* wherethrough pistons 43 are journaled. So arranged, by appropriately pressurizing actuators 36*a* and 36*c* or 36*b* and 36*d*, directs drilling fluid to one end or the other thereof to extend or retract, respectively, pistons 43 and 47. The steering yoke 41 will thereby be appropriately rotated between a centered attitude, when no deviation exists, to opposite limits of its arc of travel. Rotation of the steering yoke 41, as will be explained later herein with respect to FIG. 7, provides a bending movement on drill shaft 11 by turning jacking scres 49 inwardly to engage the drill shaft or turns jacking screws 49 outwardly from body 23 to engage the well bore wall 29.

Figure 7:
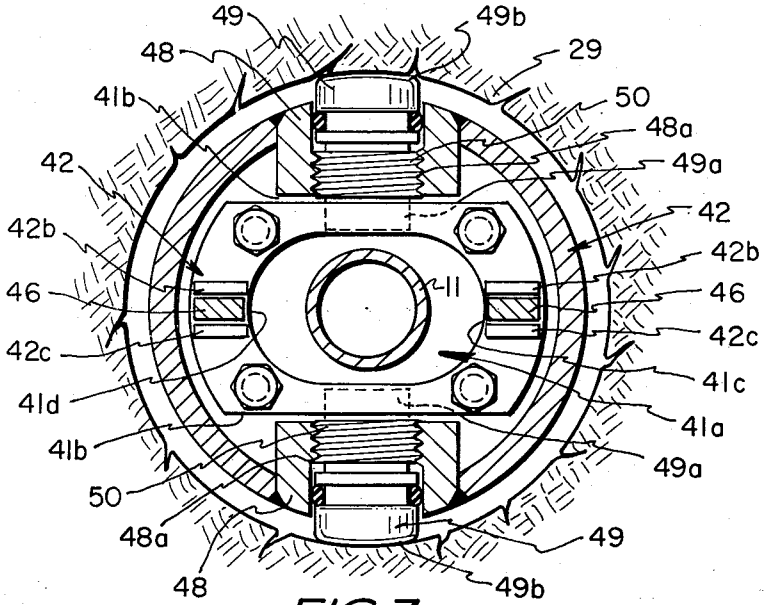

FIG. 7 is included to further explain the preferred steering arrangement of the drill stabilizer assembly therein, is shown an end sectional view of the yaw steering yoke 41, hereinafter referred to as steering yoke 41, of the drill stabilizer assembly 10 that is shown arranged within a well hole 29. Shown therein, the steering yoke 41 is pivotally coupled to bars 46 at pivot 42 by a pin, not shown, that extends between upper and lower steering yoke tabs 42*b* and 42*c*. The drill shaft 11 is shown fitted through an oblong opening 41*a* in the steering yoke 41 and opposite flat sides 41*b* thereof have jacking screw mounting blocks 48 secured thereto that are each internally threaded at 48*a* to accommodate threads 50 of a jacking screw 49 turned therein. So arranged, by appropriate operation of actuators 36*a*, 36*b*, 36*c* and 36*d* as described, pistons 47 and 43 will be extended and retracted thereby pivoting the steering yoke 41 such that ends 41*c* and 41*d* of the elongated opening 41*a* will contact, at either extreme of travel, the drill shaft 11.

In FIG. 6 the actuator and piston arrangement is shown at one limit of travel thereof. By reversing the fluid flow to the actuators to extend piston 43 of actuators 36*b* and 36*d* and to retract piston 43 of actuators 36*a* and 36*c*, the steering yoke 41 would then be rotated oppositely. When a differential pressure below a certain limit as set at actuator valves 35*a* and 36*b* is sensed at the differential pressure valve 31, the steering yoke 41 would rest at approximately a normal angle to drill shaft 11.

Shown in FIG. 7, as the steering yoke 41 is pivoted, the jacking screw mounting blocks 48 are also pivoted. Thereby, the jacking screws 49 will be turned therein. The jacking screws 49, as shown in the solid line configuration of FIG. 7, can be arranged to extend outwardly therefrom to engage the well hole wall 29, or, as shown by broken line ends 49*a*, they can be arranged to extend inwardly to engage the drill shaft 11. The particular configuration of each jacking screw 49, whether it is arranged to extend outwardly or inwardly is determined by whether a bending force is to be applied directly to the drill shaft 11 or against the well bore wall 29 by contact of jacking screw faces 49*b* thereagainst. The threads 50 of each jacking screw 49 are preferably a fast thread configuration, or the like, such that even with the limited arc of travel of the steering yoke 41, the jacking nuts will sufficiently extend to create a required bending moment. Such fast threads may involve multiple threads arranged on the jacking screw such that the pitch, or the distance between the adjacent threads, will be long and/or may include distinct threads arranged on either side thereof to provide sufficient thread surface for supporting the force applied by the pivoting of the steering yoke 41. Such configuration could also include two or three distinct threads to maintain a good thread contact area along with a desired pitch distance to provide required jacking screw extension.

As per the above, the operation of the pitch and/or yaw actuators provides a bending movement through the pitch and yaw steering yokes 39 and 41. The above discussion, of course, involves a comparison venturi head losses that occur across the drill stabilizer assembly, with a differential head loss causing an appropriate extension or retraction of jacking screws, or the like, to effect a change in drilling direction. However, a comparison of venturi head losses could be made against a fixed pressure, such as the pressure of the fluid passing through the drill shaft 11. Further, the sensor units 19 of the drill stabilizer assembly 10 could obviously be arranged at intervals other than ninety degrees (90°) around the body 23. For example, the sensor units could be spaced one hundred twenty degrees (120°) apart, operating as three independent units, or at seventy-two degree (72°) intervals, operating as five independent units, or the like, within the scope of this disclosure.

Referring to FIG. 2, therein the drill shaft 11 is as extending through the drill stabilizer assembly 10, the drilling fluid passing through the longitudinal passage 11*a* therein, with a portion of that fluid tapped through fluid ports 18 and into the spherical bearing 51. Spherical bearing 51 supports the turning of the drill shaft 11 with the drill stabilizer assembly 10 remains stationary. Fluid passed through the fluid ports 18 is, of course, under pressure and is directed through appropriate lines and through a fluid control metering manifold 52 that is located adjacent to the spherical bearing 51. The fluid control metering manifold 52 controls fluid flow to provide a needed volume and pressure of fluid as required to the described units and elements of the present invention. Shown in FIG. 5, fluid flows from that fluid control metering manifold 52 are split at junctions 53, with a portion of that fluid traveling therefrom through the actuator valves 35*a* and 35*b*, thence to the described actuators, with the balance thereof flowing to the differential pressure valves 31 and venturis 28*a* and 28*b*.

Shown in FIG. 2, the present invention in a drill stabilizer assembly 10 is preferably connected at forward end 23*b* thereof to the reaming collar 13 and drill bit 12. Reaming collar 13, additional to guiding the assembly, functions as a fulcrum, the assembly bending therearound when the jacking screws 49 are turned, as described. Guide ribs 54, shown in FIGS. 1 and 2, are preferably included on body 23 for guiding drill stabilizer assembly 10 along the well bore wall 29, that position and stiffen the device.

Figure 8:
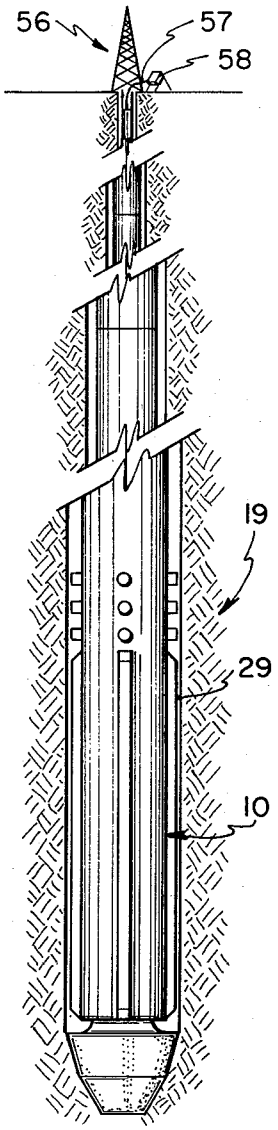
Figure 9:
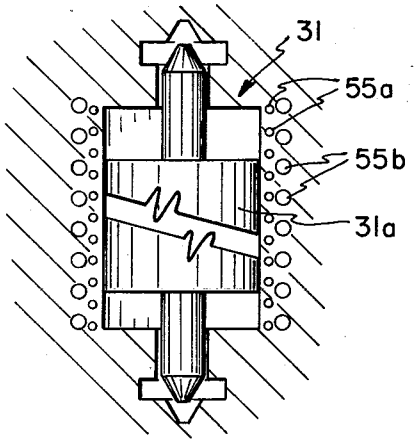

As an additional element and capability to the described embodiment of the drill stabilizer assembly 10, as shown best in FIG. 9, the differential pressure valve 31 can include magnetic windings 55*a* and 55*b* therearound. In this arrangement, the piston 31*a* thereof will need to be formed from a conductive metal whereby electrical control and sensing of the piston 31*a* position can be provided by introduction of appropriate electrical currents through windings 55*a* and 55*b*. So arranged, information reflective of piston position as related to deviation and correction indications can be transmitted over wieres, by radio, or the like, to a surface installation, such as that shown in the schematic of FIG. 8. Therein, the drill stabilizer assembly 10 is shown installed within a well bore, and is connected to receive and pass electrical signals to a surface installation. Such signals preferably are digital representatives of piston 31*a* location as for example: a plus one (+1) represents up-on; zero (0) represents neutral; and minus one (−1) is down-on, with no signal generated between a control position and limits of piston travel. Such signal transmission permits monitoring by simple pulse counting and/or control by generating of pulses, as is explained hereinbelow. FIG. 8 shows the well bore terminating below a surface tower 56, and a preferred electrical connection between the drill stabilizer assembly 10 and a controller 58 is shown as wires 57. So arranged, the position of the piston 31*a* of the differential pressure valve 31, can be continuously monitored by the surface controller 58, that can take into account deviations and corrections, the time the piston is at a limit of travel, and drill string length to mathematically provide a continuous plotting of drill bit location in both vertical and horizontal drilling operations. Such data can not only be used to monitor drill bit movement and location, it can also be used to provide information about the makeup of the rock material therethrough drilling is progressing.

Additional to the monitoring capability outlined hereinabove, by providing appropriate electrical signal to winding 55*a* or 55*b*, the piston 31*a* of the differential pressure valve 31 can be operated as a solenoid. Thereby, piston 31*a* can be moved between up-on, neutral and down-on positions at the direction of controller 58. Such piston 31*a* movement, of course, is sensed as a deviation and commands a generation of a correction signal to the pilot control valves 34*a* and 34*b* to operate the actuator valves 35*a* and 35*b*, as shown and described earlier herein with respect to the schematic of FIG. 5. So operated, a change in drilling direction can be effected, the surface controller 58 "steering" the drill stabilizer assembly 10 and the drill bit 12 through the earth. The windings 55*a* or 55*b* are preferably separate windings, one to operate piston 31*a* and the other set to monitor piston 31*a* movement, as described hereinabove.

It should be also understood that the above-described drill stabilizer assembly 10 like a hereinafter described drill stabilizer assembly 60 could further include an arrangement, such as a spring timer, or the like, not shown, for holding in a correction command a sufficient time period to complete a drilling direction change so as to overcome the sensed or induced deviation to bring the drilling direction back to a desired or programmed line. Such holding in of a correction command would, of course, be programmed taking into account the drill bit capabilities and the rock material makeup wherethrough drilling is progressing.

Figures 10, 10A, 10B, 10C, 11:
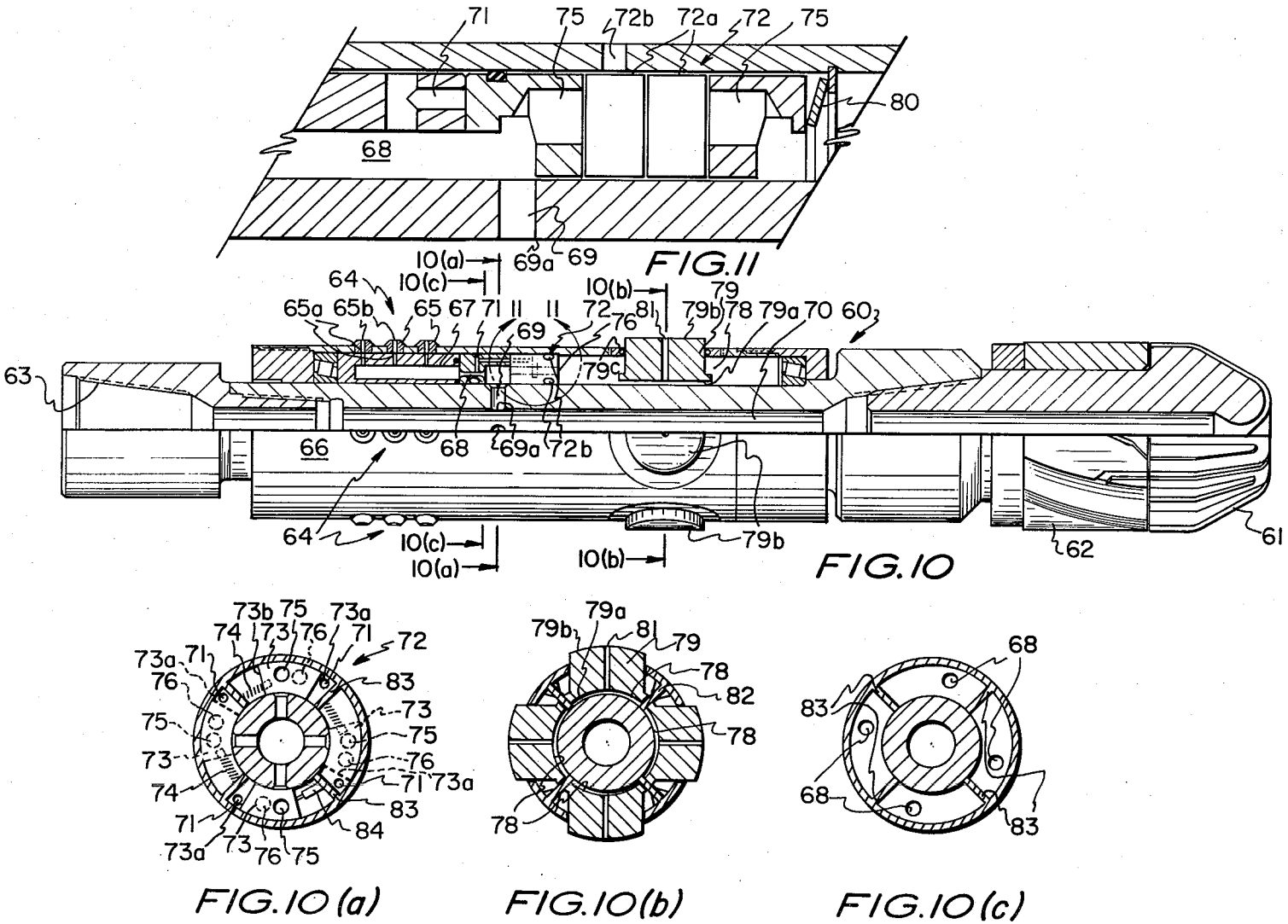

Shown in FIG. 10 is second embodiment of the present invention in a drill stabilizer assembly 60 that should be understood to be intended for arrangement, like the described drill stabilizer assembly 10, between a conventional drill bit 61 and attached reaming coliar 62, and is connected to a conventional drill string 63 that includes a drill shaft 70 which is open longitudinally to pass drilling fluid therethrough. Drill stabilizer assembly 60 should be understood to also include appropriate parts for passing drilling fluid into the drill stabilizer assembly 60 as both a sensing and energy or working media. Further, a preferred connection arrangements should be understood to be like those described with respect to drill stabilizer assembly and so will not be further discussed herein.

The drill stabilizer assembly 60, shown best in the sectional view of FIG. 10, preferably includes sensor unit 64 that should be taken as being like the sensor unit 19 described earlier herein with respect to drill stabilizer assembly 10 and includes groups of sensors 65 spaced at intervals around a cylindrical body 66. Shown in FIG. 10, the sensors 65 are also preferably arranged in tandem groups of three and are spaced apart at ninety degree (90°) intervals. The sensors 65 are like those described with respect to FIGS. 2 and 4, each including outlet ports 65*a* and orifices 65*b*. The outlet ports are connected to a common reservoir 67 wherethrough flows drilling fluid under pressure. Drilling fluid thereby passes from reservoir 67, through an outlet port 65*a*, and is sprayed from orifices 65*b* against a well bore wall, not shown. The sensors 65 preferably operate like sensors 25 described earlier herein with respect to drill stabilizer assembly 10, with the distance of orifices 65*b* ends from the well bore wall determining head losses that are averaged in the sensor unit 64 and control, as will be explained later herein, the fluid flow through a rotary valve 72.

In FIG. 10, the reservoir 67 is shown connected through a venturi 68 that passes fluid therethrough from a pickup port 69. The pickup port, in turn, connects through an appropriate port 69*a* into the fluid flow traveling through the drill shaft 70. Of course, as the drill shaft 70 is turning and the drill stabilizer assembly 60 is essentially stationary, a number of ports 69*a* need be provided around the drill shaft to align with the pickup port 69 to pass an adequate fluid flow. So arranged, the head losses created by the fluid flow through the sensors 65 controls fluid flow both through the venturi 68 and through rotary valve 72 of each sensor unit 64, which rotary valve is shown in FIG. 10(*a*) and in an expanded sectional view in FIG. 11.

Shown in sectional view of FIG. 10(*a*) and the expanded sectional view of FIG. 11, rotary valve 72 is preferably a stacked valve having duplicate independent sections or cavities 72*a*. Each cavity 72*a* is arranged to receive fluid flow through both a venturi port 71, as shown best in FIG. 10, and through an opening 75 that connects, as shown best in FIG. 11, to pickup port 69. As shown best in FIG. 10(*a*), each venturi port 71 passes fluid therethrough into a valve cavity 72*a* or rotary valve 72, that fluid entering along one side 73*a* of a slide 73. The volume of the fluid flow, through venturi port 71, as detailed hereinabove, is controlled by the head losses through the sensors 65 as governed by the proximity of the orifices 65*b* ends from the well bore wall with venting to outside, provided through ports 72*b* when slide 73 is positioned to block fluid flow as when no differential pressure exists.

Shown best in FIG. 11, to best utilize the space available within cylindrical housing 66, the rotary valve 72 is preferably arranged as a stacked valve with back to back two cavities 72*a*, each receiving fluid flows from venturi lines 71 and through openings 75 that connect to pickup ports 69, as shown best in FIGS. 10(*a*) and 11. Each cavity 72*a* includes a slide 73 arranged to travel therein, and the cavitites are separated by webs 83, as shown best in FIG. 10(*a*). Fluid passed from each venturi line 71, thereby passes into cavity 72*a* as shown in FIG. 10(*a*), and acts against a side 73 or slide 73. The opposite slide side 73*b* thereof, as shown best in FIG. 11 continuously receives a fluid flow through openings 75 from pickup port 69 thereby maintaining a pressure head against a slide 73 side 73*b* that must be overcome by the pressure of the fluid entering through venturi port 71. Further biasing may be preferably provided, as needed, by springs 74, and, as shown in a lower right hand quadrant of FIG. 10(*a*), spring 74 can be replaced with a solenoid 84 whose function will be described in detail later herein. In FIG. 10(*a*), each slide 73 opening 75 is shown arranged in the slides in two chambers 72*a* to align with opening ports 76 that are shown in broken lines in FIG. 10(*a*) and should be understood to pass fluid into a push-off pad chamber 78, shown best in FIG. 10. So arranged, depending upon the position of slide 73, opening 75 and port 76, respectively, will partially or completely align to pass a controlled fluid flow therethrough and into push-off pad chamber 78. Thereby, the position of slide 73 within chambers 72*a* relative to the openings 75 and ports 76 therethrough, controls the fluid flow into the connected push-off pad chamber 78.

The fluid entering push-off chamber 78, as shown best in FIGS. 10 and 10(*b*), will act against the undersurface 79*a* of push-off pad 79 to extend that push-off pad such that an upper surface 79*b* thereof will contact the well bore wall. So operated, the extended push-off pad 79 applies a force against the well bore wall, forcing the stabilizer assembly 60 away therefrom and creating a bending moment around reaming collar 62, as described earlier herein with respect to the operation of the drill stabilizer assembly 10, to provide a desired drilling direction change.

Appropriate to both embodiments of drill stabilizer assembly 10 and 60, there obviously would be some lag time between when an appropriate push-off pad 79 or actuators 36*a*, 36*b*, 36*c* and 36*d* are operated to change the drilling direction and when the drilling direction is actually returned to its desired path. To provide for holding an appropriate push-off pad or set of actuators in an extended attitude for a sufficient time to effect that drilling direction correction, the present invention, preferably includes an arrangement for continuing an appropriate fluid flow thereto over a sufficient time period. Such an arrangement for drill stabilizer assembly 60, is shown in FIG. 11 as a bellville spring 80 for maintaining a fluid pressure in the push-off pad chamber 78 a sufficient time period after the rotary valve 72 has reduced flow therethrough to provide, along with a longitudinal hole or opening 81 in push-off pad 79, for a timed release of fluid pressure from push-off pad 79 after the slide 73 has returned to a no-deviation attitude. So arranged, the bellville spring is preferably set to remain open a certain time period that takes into account the rock material being drilled through, the drill bit capabilities, and the like. While a bellville spring 80 is shown herein as being preferred for drill stabilizer assembly 60, it should be obvious that other timer arrangements for use with either or both drill stabilizer assembly embodiments such as a friction lock spring, or the like, could be so used within the scope of this disclosure, as say to hold slide 73 or pilot control valves 34*a* and 34*b* in a desired fluid passing attitude over a sufficient time period to effect the desired drilling direction change.

Preferably, as shown best in FIGS. 10 and 10(*b*), each push-off pad 79 incorporates the longitudinal hole or opening 81 to provide a constant fluid flow from the push-off pad cavity 78 when the push-off pad is not in a well bore wall engaging attitude. Thereby a constant bleed is effected. Further, appropriate seals 79*c* are included to restrict fluid flow from the push-off pad chamber 78 to beyond body 66. Shown best in FIGS. 10(*b*) and 10(*a*), respectively, the chambers containing push-off pads 79 and slides 73 are separated from one another by webs 82 and 83, respectively.

In the described embodiment of drill stabilizer assembly 60, as with drill stabilizer assembly 10, the sensor units 64 and 19, respectively, and the actuators or push-off pads controlled thereby can be arranged to operate in pairs. So arranged, the sensor units are preferably damaged across from one another. Or the sensor units can be arranged to operate independently of one another, each comparing head losses against a fixed standard, such as the drilling fluid flow through the drill shaft to determine a differential pressure. Such independent operaton could involve the numbers of sensor units and their arrangement described earlier herein.

Further, as detailed earlier herein with respect to the drill stabilizer assembly 10, it is also desirable to provide for surface control, and monitoring of the drill stabilizer assembly 60. To provide such surface monitoring and control, as shown best in FIG. 10(*a*) at a lower right hand quadrant thereof, the described spring 74 could be replaced with a solenoid 84, or the like. Such solenoid 84 can be electrically connected to an appropriate unit within the assembly or to a surface controller, as described with respect to the drill stabilizer assembly 10 differential pressure valve 31, to provide a controlled biasing of slide 73. When so connected by wires, or the like, to a surface controller, not shown, solenoid 84 can not only be operated to move slide 73 appropriately, it can also transmit slide 73 position information to such controller. While solenoid 84 is preferred, it should be obvious that another such arrangement for controlling and monitoring slide 73 could be so employed within the scope of this disclosure.

Both drill stabilizer assemblies 10 and 60 of the present invention, as detailed earlier herein are useful as "smart" devices that are capable of operating without connection to a surface controller, and each embodiment uses drilling fluid as both the sensing and energy or working media to counter unprogrammed deviations from a desired drilling path or direction, or by including of windings 55*a* and 55*b*, or the like, with the differential pressure valve 31 of drill stabilizer assembly 10, or substituting solenoids 84 for springs 74 for drill stabilizer assembly 60, and linking those windings or solenoids appropriately to an internal or surface controller, as by wires, radio control, or the like, the present invention can be operated under control of a surface operator, a computer, or like controller. When so connected to a surface controller, appropriate signals, preferably digital pulses, can be transmitted to and back from either drill stabilizer assembly 10 or 60 to both control operation thereof and for recording of deviations and/or corrections from and back to a desired drilling path with this information, and taking into consideration the length of the drill string, a continuous plotting of drill bit location can be made. Also, this information can be useful for determining the makeup of the material being drilled through.

While a preferred embodiment of our invention in embodiments of an active hydro-mechanical drill stabilizer assembly has been shown and described herein, it should be understood that the present disclosure is made by way of example and the variations are possible without departing from the subject matter coming within the scope of the following claims, which claims we regard as our invention.

We claim:

1. A drill stabilizer assembly comprising, a body for arrangement within a well bore having a drill shaft journaled therethrough that connects to a drill bit;

means for connecting said drill shaft to a drill string;

sensor means arranged with said body to pass a fluid medium therethrough and direct it against the well bore wall sensing, as a differential pressure drop, when compared with another fluid pressure, an area of unequal spacing of said body from said well bore wall;

valve means arranged with said body and operated by said differential pressure drop to control a fluid medium flow passed therethrough;

a fluid medium source connected to pass said fluid medium flows to said sensor means and said valve means; and means operated by said fluid medium flow from said valve means for applying a bending force associated with said body to provide a change in drilling direction.

2. A drill stabilizer assembly as recited in claim 1, wherein the body is cylindrical and includes, coupling means on one end thereof for releasably securing it to the drill string; and coupling means on the opposite end for releasably securing it to the drill bit.

3. A drill stabilizer assembly as recited in claim 1, wherein the sensor means consists of, ports and orifices arranged at ninety-degree intervals around the body;

means for passing a fluid medium flow through said orifices directing that flow against the well bore wall;

means for measuring the pressure drop from a port and orifice; and comparison means for evaluating the pressure drop from a port and orifice against the other fluid pressure for determining a differential pressure drop.

4. A drill stabilizer assembly as recited in claim 3, wherein the ports and orifices are arranged in tandem groups of three, the groups are essentially parallel to one another and are spaced at ninety degrees intervals around the body.

5. A drill stabilizer assembly as recited in claim 3, further including, venturi means connected to pass the fluid medium flow therethrough to said ports and orifices; and means connected to said venturi means for sensing a pressure head loss thereat; and means for determining pressure head drops between two venturi means and for determining differential pressure drops.

6. A drill stabilizer assembly as recited in claim 5, wherein the means for determining pressure head losses between the venturi means and for determining differential pressure drops consist of, differential pressure amplifier control valve means connected to receive pressure head losses from both the venturi means for sensing a differential pressure therebetween and operating a piston portion thereof that travel between a neutral attitude and a travel limit; and valve and seat means operated by movement of said piston portion that controls a fluid medium flow therethrough.

7. A drill stabilizer assembly as recited in claim 6, wherein the differential pressure amplifier control valve vents to atmosphere when in a neutral attitude.

8. A drill stabilizer assembly as recited in claim 6, further including electrically conductive windings appropriately arranged with the differential pressure amplifier control valve to electrically sense the position of the piston portion thereof;

the piston portion is formed from an electrically conductive material; and means for electrically connecting said electrically conductive windings to a surface controller.

9. A drill stabilizer assembly as recited in claim 8, wherein the electrically conductive windings are electrically independently connected to the surface controller.

10. A drill stabilizer assembly as recited in claim 7, wherein the controller is a computer means for monitoring drill bit position from data received from the electrically conductive windings and taking into account drill string length for plotting drill bit location.

11. A drill stabilizer assembly as recited in claim 6, further including differential pressure amplifier control valve means passes a fluid medium flow pilot valve means for controlling appropriately fluid medium flow to the means for applying a bending force.

12. A drill stabilizer assembly as recited in claim 6, further including, as the means for applying a bending force, actuator means controlled by the fluid medium flow from the differential pressure amplifier control valve means for extending and retracting appropriately piston portions thereof;

means for anchoring said actuator means in the body;

steering yoke means connected to said piston portion of each actuator means to be pivoted thereby; and screw means arranged with said steering yoke means to be appropriately extended and retracted by pivoting thereof for applying the force to change drilling direction.

13. A drill stabilizer assembly as recited in claim 12, wherein the screws means consist of jacking screws that are threaded appropriately and turned into mounting blocks secured to the steering yoke, and are extended and retracted by pivoting of said steering yoke such that ends thereof engage the drill shaft to provide a bending force thereagainst.

14. A drill stabilizer assembly as recited in claim 13, further including a reaming collar means secured between the drill bit and body for providing a fulcrum.

15. A drill stabilizer assembly as recited in claim 12, wherein the screw means consists of, jacking screws that are threaded appropriately and turned into mounting blocks secured to the steering yoke and are extended and retracted by pivoting of said steering yoke such that ends thereof engage the bore hole wall to provide a bending force thereagainst.

16. A drill stabilizer assembly as recited in claim 15, further including, a reaming collar means secured between the drill bit and body for providing a fulcrum.

17. A drill stabilizer assembly as recited in claim 3, wherein the comparison means includes a pickup port connected to receive the fluid medium flow from the fluid medium source and to direct it to both the sensor means ports and orifices as the sensing medium and to a rotary valve means as an energy source;

port means connected to pickup a portion of the fluid medium flow to the sensor means ports and orifices for picking up a volume of which fluid medium portion that is dependent upon head losses at said sensor means; and valve means connected to and operated by a difference in pressures of the fluid medium flows from the pickup port and port means that operates to pass a controlled fluid medium flow to the means for applying a bending force.

18. A drill stabilizer assembly as recited in claim 17, wherein the pickup port is arranged to align with openings into the drill string to pass a fluid medium flow therethrough.

19. A drill stabilizer assembly as recited in claim 17, wherein the port means is a venturi port that connects for passing the fluid medium flow to one side of a slide portion of the valve means; and the valve means is a rotary valve that includes a chamber wherein said slide portion is arranged to move in responsive to the fluid medium flows passed thereto, which slide movement controls alignment of transfer ports therethrough that pass a fluid medium flow to the means for applying a bending force, governing, thereby, the volume of fluid medium flow as an energy source to said means for applyng a bending force.

20. A drill stabilizer assembly as recited in claim 19, wherein the rotary valve includes a chamber wherein the slide portion is arranged to travel; and further including spring biasing of said slide portion against the pressure of the fluid medium flow.

21. A drill stabilizer assembly as recited in claim 19, wherein the rotary valve includes a plurality of independent chambers each including separate slide portions port means and transfer ports.

22. A drill stabilizer assembly as recited in claim 21, wherein the rotary valve is a stacked valve.

23. A drill stabilizer assembly as recited in claim 19, wherein the means for applying a bending force includes a chamber within the body and connected to receive a fluid medium flow from the valve means; and push-off pad means arranged to extend, when a sufficient pressure of fluid medium is present, outwardly, from said chamber, to beyond said body, to contact a well bore wall.

24. A drill stabilizer assembly as recited in claim 23, further including seal means associated with said push-off pad means to contain the fluid medium within the chamber; and bleed means associated with said push-off pad means to provide a bleed off flow therethrough from the chamber to without the body.

25. A drill stabilizer assembly as recited in claim 23, wherein a plurality of separate chambers and push-off pad means are arranged at intervals around the body and are each operating independently.

26. A drill stabilizer assembly as recited in claim 19, further including means for remotely controlling valve means slide portion positioning.

27. A drill stabilizer assembly as recited in claim 26, wherein the means for remotely controlling the valve means slide portion positioning consists of, a solenoid arranged in the chamber and connected to the slide portion to more appropriately that slide portion; and means for controlling said solenoid operation to move said slide portion appropriately.

28. A drill stabilizer assembly as recited in claim 27, wherein the means for controlling said solenoid operation consists of a surface controller; and means for electrically connecting said controller to said solenoid.

29. A drill stabilizer assembly as recited in claim 17, further includng a reaming collar means secured between the drill bit and body for providing a fulcrum.

30. A drill stabilizer assembly as recited in claim 1, further including means for continuing a fluid medium flow to the means for applying a bending force for a time period sufficient to provide a desired drilling direction change.

31. A drill stabilizer assembly as recited in claim 1, wherein the fluid medium is drilling fluid.

* * * * *